US007107954B2

(12) United States Patent
Yamashita et al.

(10) Patent No.: US 7,107,954 B2
(45) Date of Patent: Sep. 19, 2006

(54) INTERNAL COMBUSTION ENGINE HAVING THERMAL STORAGE DEVICE

(75) Inventors: Yoshio Yamashita, Susono (JP); Rentaro Kuroki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/171,345

(22) Filed: Jul. 1, 2005

(65) Prior Publication Data

US 2006/0000428 A1 Jan. 5, 2006

(30) Foreign Application Priority Data

Jul. 2, 2004 (JP) ..... 2004-196591
Jun. 24, 2005 (JP) ..... 2005-185148

(51) Int. Cl.
*F02N 17/02* (2006.01)

(52) U.S. Cl. ..... 123/142.5 R; 123/41.74

(58) Field of Classification Search ..... 123/142.5 R, 123/41.74

See application file for complete search history.

(56) References Cited

FOREIGN PATENT DOCUMENTS

| | | | |
|---|---|---|---|
| DE | 2 201 408 | A1 | 8/1973 |
| EP | 1 176 040 | A2 | 1/2002 |
| EP | 1 188 922 | A2 | 3/2002 |
| FR | 2 697 869 | A1 | 5/1994 |
| JP | A-07-224651 | | 8/1995 |
| JP | A-2002-021560 | | 1/2002 |
| JP | A-2002-021626 | | 1/2002 |
| JP | A-2003-003843 | | 1/2003 |

*Primary Examiner*—Noah P. Kamen
(74) *Attorney, Agent, or Firm*—Oliff & Berridge PLC

(57) ABSTRACT

An engine is arranged in such a way that while the engine is running, cooling fluid flows along a flow path that goes into a cylinder block (12) from an inlet (12*b*) at one end side of the engine main body (10), goes around the first cylinder (13) to the fourth cylinder (16) arranged in a row to go by way of the other end side of the engine main body (10), and then goes to a cylinder head (11) through a communication channel (17) and a flow path that goes into the cylinder block (12) through the inlet (12*b*) at the one end side of the engine main body (10) and then directly goes to the cylinder head (11) through the communication channel (17). During the preheat process, warm cooling fluid stored in a thermal storage tank (20) enters into the cylinder block (12) from an inlet (12*a*) at the other end side of the engine main body (10), then flows in the direction from the fourth cylinder (16) toward the first cylinder (13) while diverging to both sides of the row of the cylinders, and flows into the cylinder head (11) through the communication channel (17).

16 Claims, 9 Drawing Sheets

INTERNAL COMBUSTION ENGINE HAVING THERMAL STORAGE DEVICE

BACKGROUND OF THE INVENTION

1. Field of the Invention

The present invention relates to an internal combustion engine having a thermal storage device.

2. Description of the Related Art

Demands for improvement of startability, reduction of fuel consumption and improvement of emission are placed on internal combustion engines that are in a cold state. To meet these demands, there is a known technology utilizing a thermal storage device as a technology for heating the internal combustion engine in an early stage (see for example, Japanese Patent Application Laid Open No. 2002-21560). In this technology, cooling fluid in a cooling device is utilized. Specifically, according to this technology, a portion of the cooling fluid that has been heated during running of the engine is stored in a thermal storage tank while keeping its heat even after the engine has been stopped, and the warm cooling fluid is returned to the engine before starting the engine. (In the following description, the operation of returning heated cooling fluid to the engine before starting it will be referred to as "preheat process".)

Here, an example of an internal combustion engine having a thermal storage device according to a related art will be described with reference to FIGS. 1 and 2. FIGS. 1 and 2 are schematic diagrams showing an internal combustion engine having a thermal storage device according to a related art. The arrows in FIG. 1 indicate flows of cooling fluid that serves as heat medium during the preheat process. The arrows in FIG. 2 indicate flows of cooling fluid while the engine is running.

As shown in these drawings, the internal combustion engine having a thermal storage device 200 has an engine main body 210 including a cylinder head 211 and a cylinder block 212, a thermal storage tank 220 for storing a portion of the cooling fluid serving as heat medium that has been heated by the engine main body 210 while keeping its heat, an electric pump 230 for causing the cooling fluid to flow out of the thermal storage tank 220, a mechanical pump 240 driven by a belt (not shown) provided in the engine main body 210, a three-way valve 250 for switching the flow path through which the cooling fluid runs, a heater core 260 used for heating the vehicle cabin and a radiator 270 for cooling the cooling fluid.

With the above-described structure, when the preheat process is performed, the electric pump 230 is turned on. At that time, the valve in the three-way valve 250 that leads to the heater core 260 is closed. Accordingly, the cooling fluid flows along a circulative flow path running through the thermal storage tank 220, the cylinder block 212 and the cylinder head 211 as shown in FIG. 1. Thus, warm cooling fluid stored in the thermal storage tank 220 is supplied to the cylinder block 212 and the cylinder head 211. As per the above, since the cylinder block 212 and the cylinder head 211 are heated before starting the engine, the engine warm-up process is facilitated. Afterward, the electric pump 230 is turned off, and the preheat process is terminated.

While the engine is running, the mechanical pump 240 is operated. In that time, the valve in the tree-way valve 250 that leads to the thermal storage tank 220 is closed. Accordingly, the cooling fluid flows along a circulative flow path running through the engine main body 210 and the heater core 260 and along a circulative flow path running through the engine main body 210 and the radiator 270, as shown in FIG. 2. Thus, cooling fluid warmed by the engine main body 210 is supplied to the heater core 260 and the radiator 270. Consequently, the heater core 260 and the radiator 270 are heated, and the heat of the cooling fluid is removed by the heater core 260 and the radiator 270.

There is a known method of cooling during the engine running, that is, the U-turn cooling system in which cooling fluid is supplied to the cylinder block from one end of the engine main body, and then supplied to the cylinder head after flowing by way of the other end (see, for example, Japanese Patent Application Laid-Open No. 7-224651). Some known internal combustion engines that utilize the U-turn cooling system are further provided with a flow path for feeding the cooling fluid supplied to the cylinder block from one end of the engine main body directly to the cylinder head. The main reason why the flow path for supplying the heat medium to the cylinder head after the U-turn travel in the cylinder block and the flow path for feeding the heat medium directly from the cylinder block to the cylinder head are provided is that the demand for cooling is stronger in the cylinder head than in the cylinder block in the internal combustion engine. In this connection, the internal combustion engine shown in FIGS. 1 and 2 is provided with the two types of flow paths for cooling mentioned here.

In such internal combustion engines 200 provided with two types of cooling fluid flow paths, when cooling fluid is supplied to the engine main body 210 from the thermal storage tank 220 in the preheat process also, cooling fluid is supplied to the cylinder block from the one end of the engine main body using the flow paths same as those used in supplying cooling fluid while the engine is running.

In the preheat process, it is considered to be more effective that the cylinder block be heated earlier than the cylinder head in reducing frictions in various sliding portions and in improving gas mileage.

An object of the present invention is to enhance the efficiency of heating of the cylinder block by a thermal storage device.

Another object of the present invention is to reduce fuel consumption.

SUMMARY OF THE INVENTION

To achieve the above objects, the present invention adopts the following features.

In the structure according to the present invention, a flow path that allows heat medium having been stored in a thermal storage tank to flow into a cylinder block after flowing from one end to the other end of the cylinder block. With this structure, it is possible to warm all the regions of the cylinder block efficiently at an early stage.

More specifically, an internal combustion engine having a thermal storage device according to the present invention comprises:

an engine main body having a cylinder block, a cylinder head and a cooling flow path through which heat medium flows to cool the engine;

a thermal storage tank for storing heat medium warmed by the engine while keeping its heat; and a heating flow path for feeding heat medium that has been stored in the thermal storage tank into the interior of the engine main body;

wherein a communication channel for allowing fluid communication between the cylinder block and the cylinder head is provided at one end side of the engine main body;

said cooling flow path includes a first flow path that allows heat medium to flow into the cylinder block from the one end side of the engine main body, to flow by way of the other end side of the engine main body, and then to flow into the cylinder head through the communication channel provided at the one end side of said engine main body, and a second flow path that allows heat medium to flow into the cylinder block from the one end side of the engine main body and to flow into the cylinder head directly through said communication channel; and said heating flow path is provided in such a way that heat medium supplied from said thermal storage tank to enter into the cylinder block from the other end side of the engine main body.

According to the arrangement of present invention, the heat medium stored in the thermal storage tank is fed into the cylinder block from the other end side of the engine main body. The communication channel that allows fluid communication between the cylinder block and the cylinder head is provided at the one end side of the engine main body. Accordingly, the heat medium supplied from the thermal storage tank is fed to the cylinder head through the communication channel after flowing from the other end side to the one end side of the cylinder block. Thus, it is possible to warm all the regions of the cylinder block efficiently. Therefore, it is possible to reduce frictions in sliding portions in the cylinder block at an early stage and to reduce fuel consumption.

The present invention also covers arrangements in which a portion for allowing fluid communication between the cylinder block and the cylinder head in addition to the "communication channel" provided at the one end side of the engine main body. However, it is necessary that the "communication channel" according to the present invention be the main flow path so that a large part of the heat medium supplied from the thermal storage tank is fed to the cylinder head through the communication channel after flowing from the other end to the one end of the cylinder block.

The aforementioned heating flow path may be constructed to include at least a part of the aforementioned first flow path. In that case, it is possible to allow the heat medium supplied from the thermal storage tank to be fed to the cylinder head through the communication channel after flowing from the other end portion to the one end portion of the cylinder block making use of the first flow path that is originally provided to allow heat medium to flow by way of the other end side of the engine main body and then to flow into the cylinder head through the communication channel provided at the one end side of the engine main body.

As a result, it is possible to warm all the regions of the cylinder block efficiently by a simple structure.

Here, said one end side and said other end side may be one and the other sides with respect to the direction of arrangement of a plurality of cylinders arranged in a row in the engine main body.

The internal combustion engine may further comprise:

a first pressure-feeding device for pressure-feeding heat medium in said heating flow path and a second pressure-feeding device for pressure-feeding heat medium in said cooling flow path, and the first pressure-feeding device feeds heat medium stored in said thermal storage tank into the engine main body in a state in which pressure-feeding operation by the second pressure-feeding device is being stopped.

The second pressure-feeding device may be a mechanical pump whose drive source is the engine.

When the pressure-feeding operation by the first pressure-feeding device is effected, a portion of the heat medium may be arranged to flow along a flow path running through said mechanical pump and returning to the thermal storage tank.

With this structure, it is possible to replace the cooling fluid staying in the mechanical pump by warm cooling fluid that has been stored in the thermal storage tank.

The above-described various structures may be adopted in any possible combination.

BRIEF DESCRIPTION OF THR DRAWINGS

DESCRIPTION OF THE PREFERRED EMBODIMENTS

In the following, the best mode for carrying out the present invention will be described by way of example based on embodiments with reference to the drawings. However, the dimensions, materials, shapes and relative positions of the components described in connection with the embodiments are not intended to limit the scope of the present invention unless specified otherwise.

Embodiment 1

Figure 1:
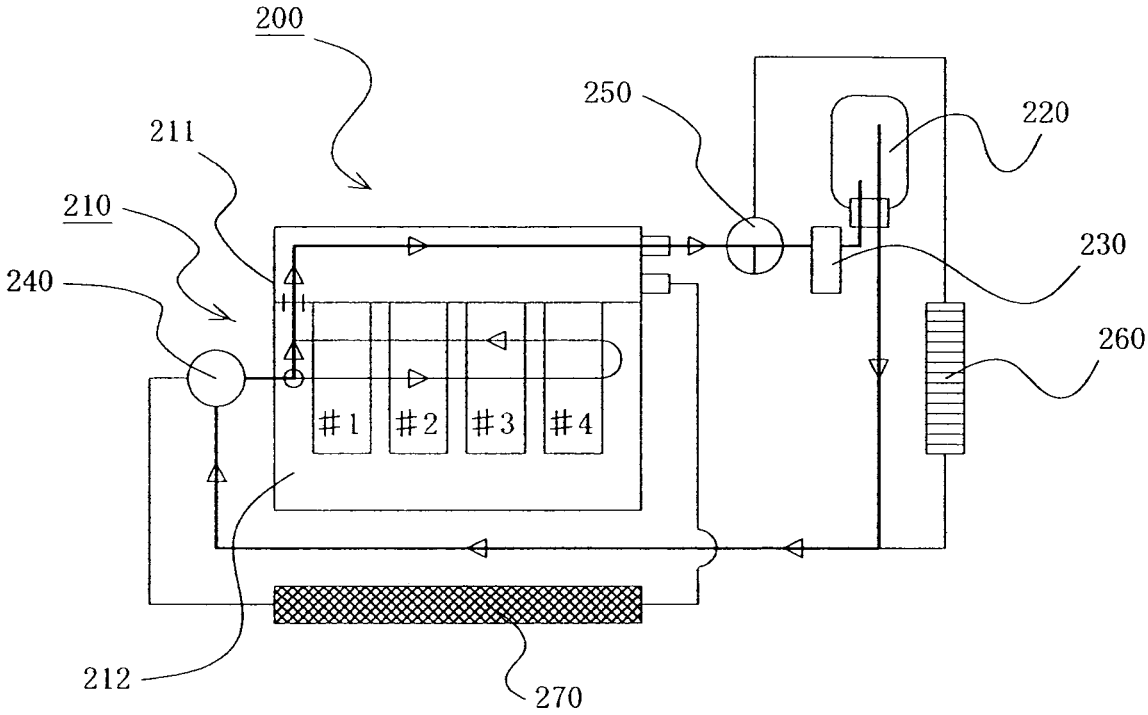
F I G. 1 Related Art
FIG. 1 is a schematic diagram showing the internal combustion engine having a thermal storage device according to a related art (schematic diagram showing flows of cooling fluid during the preheat process).
Figure 2:
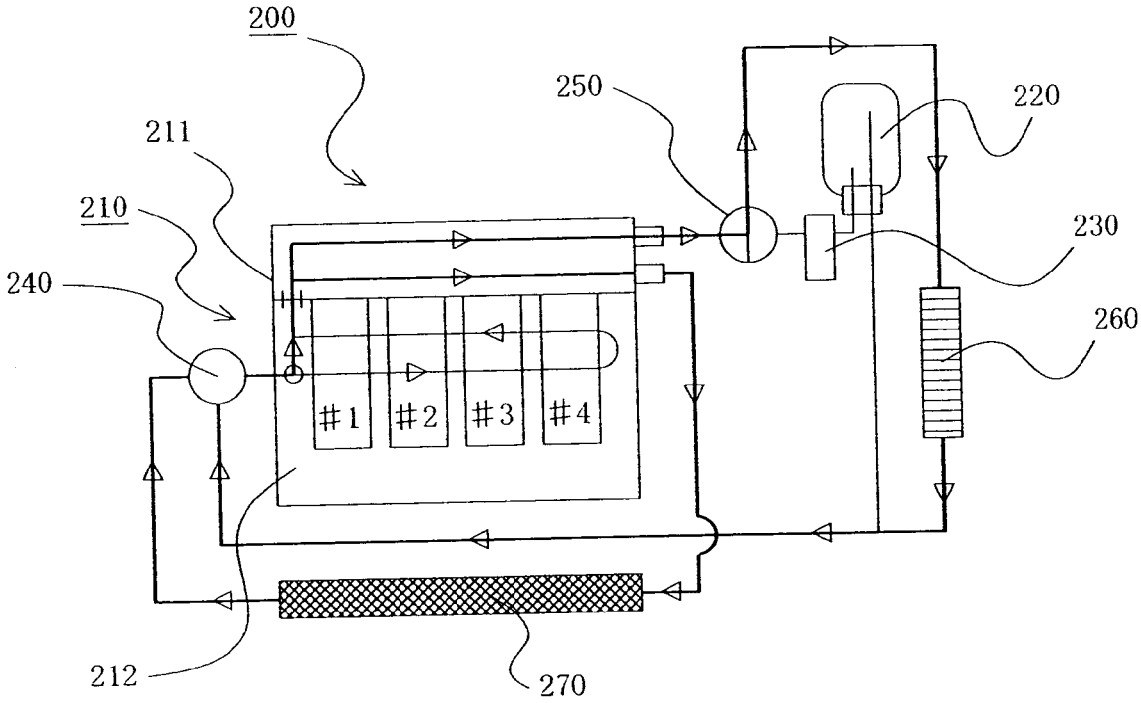
F I G. 2 Related Art
FIG. 2 is a schematic diagram showing the internal combustion engine having a thermal storage device according to the related art (schematic diagram showing flows of cooling fluid while the engine is running).
Figure 3:
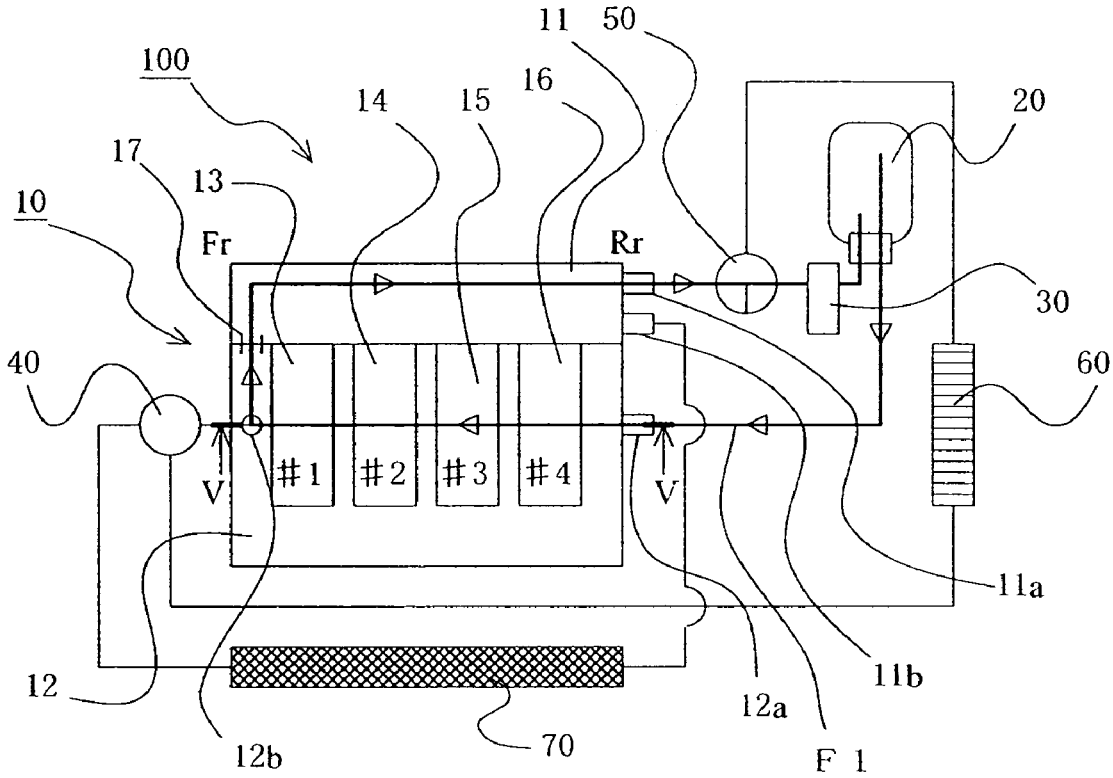
FIG. 3 is a schematic diagram showing the internal combustion engine having a thermal storage device according to embodiment 1 of the present invention (schematic diagram showing flows of cooling fluid during the preheat process).
Figure 4:
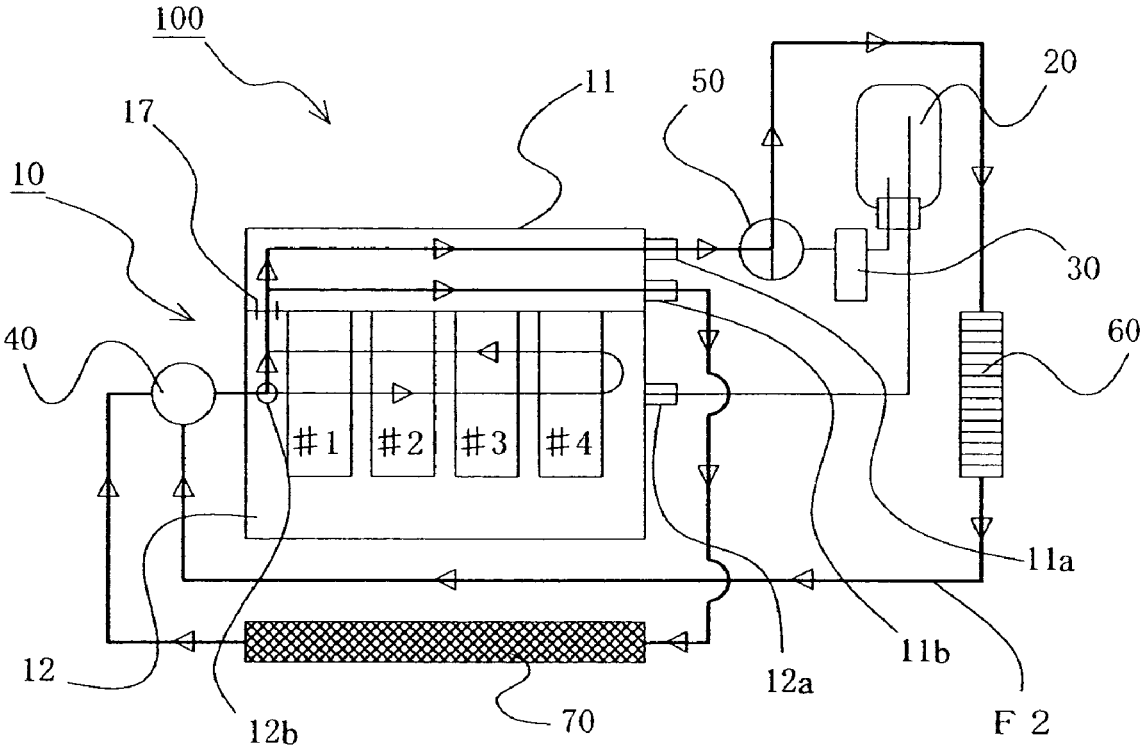
FIG. 4 is a schematic diagram showing the internal combustion engine having a thermal storage device according to embodiment 1 of the present invention (schematic diagram showing flows of cooling fluid while the engine is running).
Figure 5:
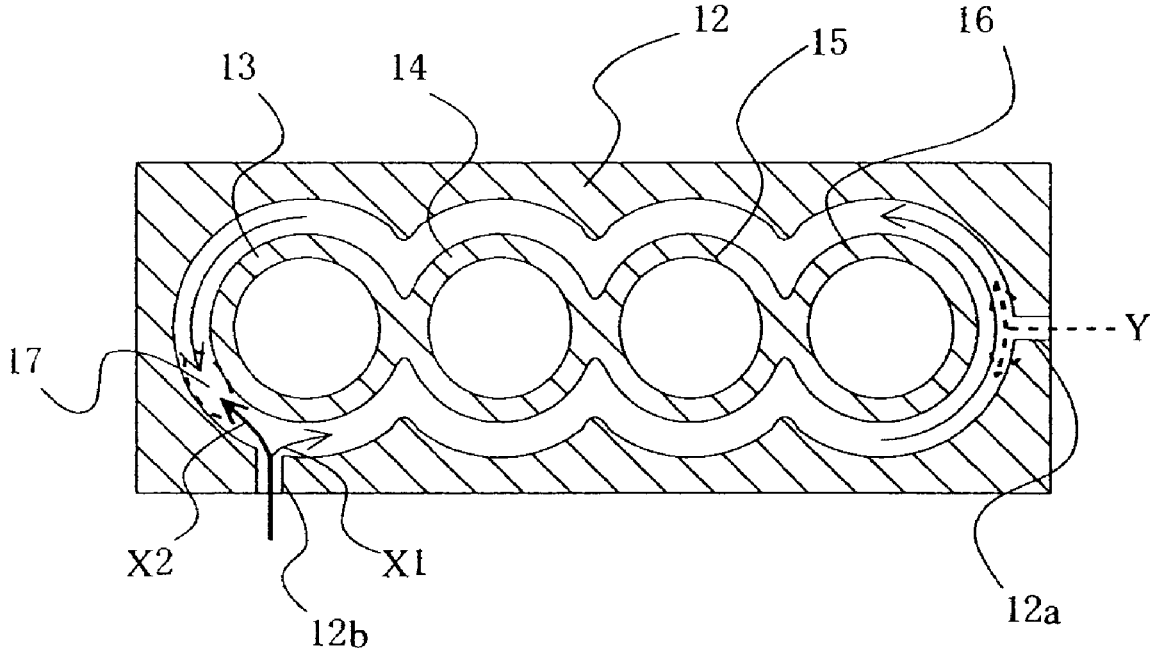
FIG. 5 is a schematic cross sectional view of the cylinder block of the internal combustion engine having a thermal storage device according to embodiment 1 of the present invention.

An internal combustion engine having a thermal storage device according to embodiment 1 of the present invention will be described with reference to FIGS. 3 to 5. FIGS. 3 and 4 are schematic diagrams showing the internal combustion engine having a thermal storage device according to embodiment 1 of the present invention. The arrows in FIG. 3 indicate flows of cooling fluid that serves as heat medium during the preheat process. The arrows in FIG. 4 indicate flows of cooling fluid while the engine is running. FIG. 5 is a schematic cross sectional view of the cylinder block of the internal combustion engine having a thermal storage device according to embodiment 1 of the present invention. FIG. 5 corresponds to the cross section taken along line v—v in FIG. 3.

<Basic Structure of the Internal Combustion Engine Having Thermal Storage Device>

As shown in the drawings, the internal combustion engine 100 having a thermal storage device according to this embodiment has an engine main body 10 including a cylinder head 11 and a cylinder block 12, a thermal storage tank 20 for storing a portion of cooling fluid serving as heat medium that has been heated by the engine main body 10 while keeping its heat, an electric pump 30 for causing the cooling fluid to flow and a mechanical pump 40 driven by a belt (not shown) provided in the engine main body 10. The internal combustion engine having a thermal storage device according to this embodiment further includes a three-way valve 50 for switching the flow path along which the cooling fluid runs, a heater core 60 used for heating the vehicle cabin and a radiator 70 for cooling the cooling fluid.

The engine described in this embodiment by way of example is a four cylinder engine, and there are four cylinders in the engine main body 10, namely, the first cylinder 13, the second cylinder 14, the third cylinder 15 and the fourth cylinder 16. In the drawings, the cylinders are designated by signs #1, #2, #3 and #4 respectively for the sake of simplicity. In this embodiment, the cylinders are arranged in such a way that when the engine main body 10 is mounted on a vehicle, the first to fourth cylinders 13 to 16 will be arranged in a row in this order from the front side (Fr) to the rear side (Rr). Hereinafter, the front end of the engine main body 10 will be referred to as the one end, and the rear end will be referred to as the other end. The above-mentioned electric pump 30 and the mechanical pump 40 correspond to the first pressure-feeding device and the second pressure-feeding device.

At the one end side of the engine main body 10, there is provided a communication channel 17 serving as the path of the cooling fluid that flows between the cylinder block 12 and the cylinder head 11. The cylinder head 11 is provided with an outlet 11*a* through which the cooling fluid flowing in the cylinder head 11 (more specifically, flowing in a water jacket provided in the cylinder head 11) flows out toward the three-way valve 50 and an outlet 11*b* through which the cooling fluid flowing in the interior of the cylinder head 11 flows out toward the radiator 70, both the outlets 11*a* and 11*b* being provided at the other end side of the engine main body 10. In addition, a thermostat (not shown) is provided at the outlet 11*b*. Thus, in the outlet 11*b*, the valve of the thermostat opens only when the temperature of the cooling fluid becomes higher than a predetermined temperature to allow the cooling fluid to flow toward the radiator 70.

The cylinder block 12 is provided with an inlet 12*b* for introducing cooling fluid that is pressure-fed by the mechanical pump 40 into the cylinder block 12 (more specifically, into a water jacket provided in the cylinder block 12), the inlet 12*b* being provided at the one end side of the engine main body 10. The cylinder block 12 is further provided with an inlet 12*a* for introducing cooling fluid that is pressure-fed from the thermal storage tank 20 by the electric pump 30 into the cylinder block 12, the inlet 12*a* being provided at the other end side of the engine main body 10

<Operation of Internal Combustion Engine Having Thermal Storage Devuce (During the Preheat Process)>

FIG. 3 shows the operation state during the preheat process. The preheat process is performed to warm the engine preliminarily before starting the engine to facilitate warm-up. The preheat process is started in response, for example, to a preheat trigger signal such as a door switch signal. Thus, the electric pump 30 is turned on in response to the preheat trigger signal. At that time, the valve in the three-way valve 50 that leads to the heater core 60 is closed. Accordingly, a circulative flow F1 of cooling fluid is generated as indicated by the arrows in FIG. 3. During the preheat process, the mechanical pump 40 is not operated, and therefore, no flows of cooling fluid are generated in the other flow paths. Afterward, the electric pump 30 is turned off to terminate the preheat process. Here, the circulative flow F1 of cooling fluid in this embodiment corresponds to the heating flow path.

The time over which the electric pump 30 is kept on is set in such a way that only warm cooling fluid stored in the thermal storage tank 20 is supplied into the engine main body 10 but cold cooling fluid staying in the engine main body 10 does not return to the engine main body 10 again after passing through the thermal storage tank 20. As per the above, it is possible to warm the engine main body 10, or the cylinder block 12 and the cylinder head 11, by means of warm cooling fluid stored in the thermal storage tank 20 before the engine is started, namely while the engine is in a cold state. Thus, it is possible to facilitate the warm-up process as described in the following.

<Operation of Internal Combustion Engine Having Thermal Storage Device (During Engine Running)>

FIG. 4 shows the operation state while the engine is running. After the above-described preheat process is completed, the mechanical pump 40 is operated with the start of the engine. At that time, the valve in the three-way valve 50 that leads to the thermal storage tank 20 is closed. Accordingly, a circulative flow F2 of cooling fluid is generated as indicated by the arrows in FIG. 4. While the engine is running, the electric pump 30 is not operated, and therefore, no circulative flows of cooling fluid are generated in the other circulative flow paths. However, in the state where the temperature of the cooling fluid is low, the valve of the thermostat provided at the outlet 11*b* is being closed, and the cooling fluid circulates only along the flow path running through the heater core 60. On the other hand, in the state where the temperature of the cooling fluid is higher than or equal to a predetermined temperature, the valve of the thermostat is being open, and the cooling fluid circulates along the flow path running through the heater core 60 and the flow path running through the radiator 70. Here, the circulative flow F2 of cooling fluid in this embodiment corresponds to the cooling flow path.

As per the above, while the engine is running, the cooling fluid is supplied to the heater core 60 and the radiator 70, so that the temperature of these portions increases while the temperature of the cooling fluid decreases. At an appropriate time while the engine is running or after the running of the engine has been stopped, the electric pump 30 is turned on to store the cooling fluid that has been heated up to a high temperature in the thermal storage tank 20 in preparation for the next preheat process.

<Details of Flows of the Cooling Fluid>

In the internal combustion engine according to this embodiment, two flow paths are provided as the flow paths through which the cooling fluid flows from the cylinder block 12 to the cylinder head 11 while the engine is running. One is a flow path that goes into the interior of the cylinder block 12 from the inlet 12*b* at the one end side of the engine main body 10, goes around the first cylinder 13, the second cylinder 14, the third cylinder 15 and the fourth cylinder 16 arranged in a row to go by way of the other end side of the engine main body 10, and goes to the cylinder head 11 through the communication channel 17 (indicated by arrow X1 in FIG. 5). This flow path in this embodiment corresponds to the first flow path. The other is a flow path that goes into the interior of the cylinder block 12 through the inlet 12*b* at the one end side of the engine main body 10 and then directly goes to the cylinder head 11 through the communication channel 17 (indicated by arrow X2 in FIG. 5). This flow path in this embodiment corresponds to the second flow path.

The reason why the two types of flow paths are provided to cool the engine is to cool the cylinder head 11 more preferentially than the cylinder block 12. In order to cool the cylinder head 11 preferentially, the flow paths are designed in such a way that the quantity of flow in the flow path directly going to the cylinder head 11 through the communication channel 17 (indicated by arrow X2) is larger than the quantity of flow in the flow path going by way of the other end side of the engine main body 10 and then going to the cylinder head 11 through the communication channel 17 (indicated by arrow X1).

On the other hand, in the preheat process, the warm cooling fluid that has been stored in the thermal storage tank 20 flows into the interior of the cylinder block 12 from the inlet 12*a* at the other end side of the engine main body 10, then flows in the direction from the fourth cylinder 16 toward the first cylinder 13 while diverging to both sides of the row of the cylinders, and flows into the cylinder head 11 through the communication channel 17 (indicated by arrows Y in FIG. 5.

As per the above, in the preheat process, since the warm cooling fluid that has been stored in the thermal storage tank 20 is carried to the cylinder head 11 after flowing from the other end side to the one end side of the cylinder block 12, all the regions of the cylinder block 12 can be warmed efficiently at an early stage. Therefore, it is possible to reduce frictions of sliding portions in the cylinder block 12 at an early stage. This leads to a reduction in fuel consumption. Furthermore, since the efficiency of heat exchange can be enhanced, it is possible to reduce the amount of warm water required for preheat, or the amount of cooling fluid stored in the thermal storage tank 20. Accordingly, it is possible to realize a reduction in the cost as well as a downsizing of the thermal storage tank 20 and a reduction in the space for accommodating it.

Embodiment 2

Figure 6:
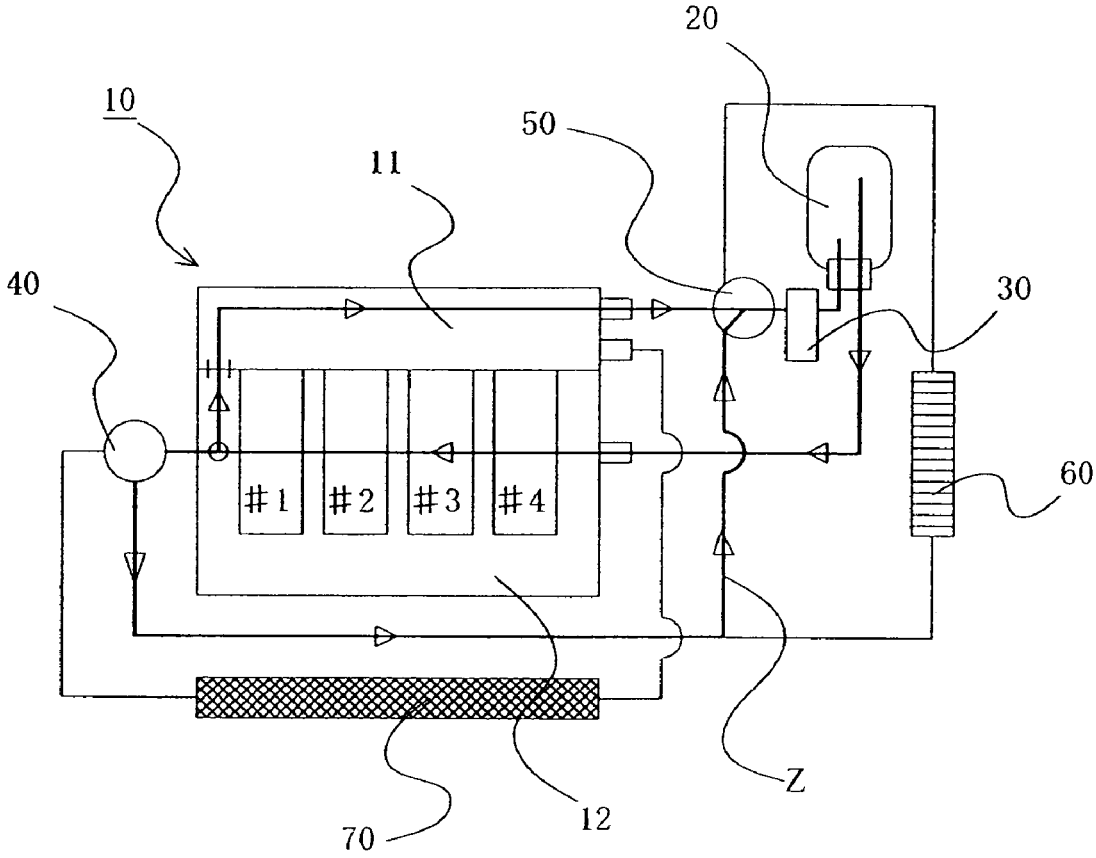
FIG. 6 is a schematic diagram showing the internal combustion engine having a thermal storage device according to embodiment 2 of the present invention (schematic diagram showing flows of cooling fluid during the preheat process).
Figure 7:
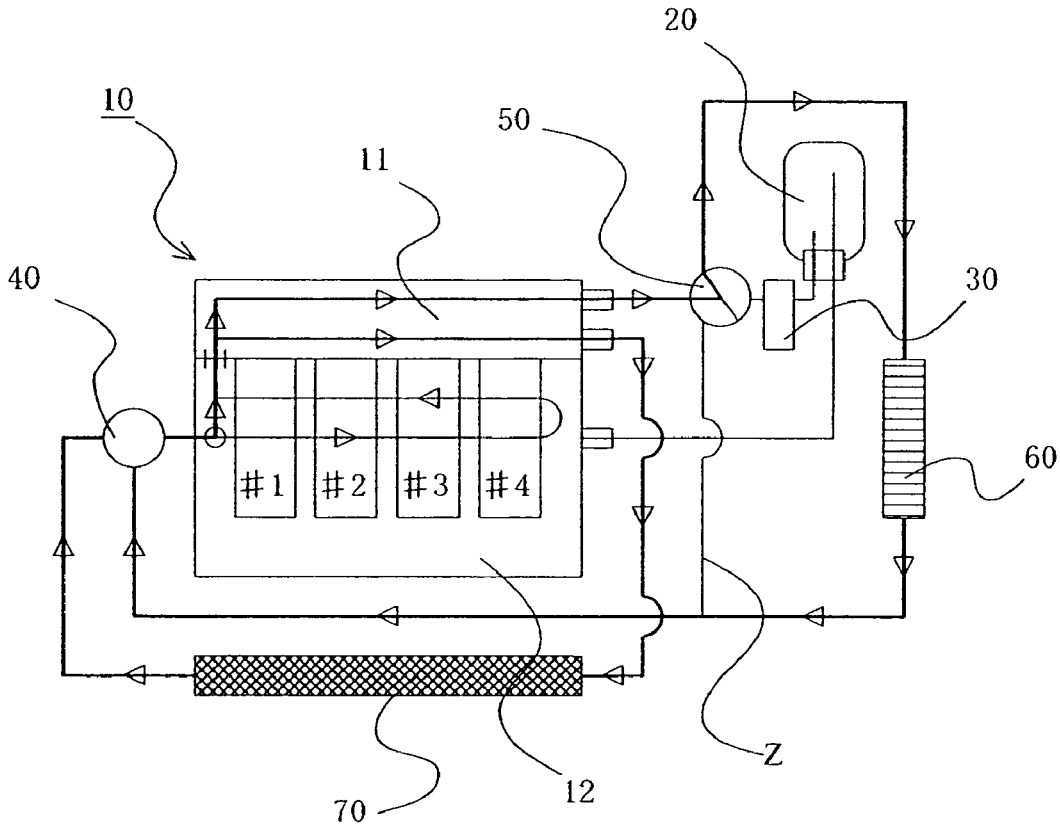
FIG. 7 is a schematic diagram showing the internal combustion engine having a thermal storage device according to embodiment 2 of the present invention (schematic diagram showing flows of cooling fluid while the engine is running).

FIGS. 6 and 7 show embodiment 2 of the present invention. In the structure that will be described as this embodiment, a flow path for replacing, in the preheat process, the cooling fluid in the interior of the mechanical pump 40 also with warm heat medium that has been stored in the thermal storage tank 20 is added to the above-described structure of embodiment 1. The other structures and operations are the same as those in embodiment 1. Accordingly, the same components will be designated by the same reference numerals, and descriptions thereof will be omitted.

FIGS. 6 and 7 are schematic diagrams showing an internal combustion engine having a thermal storage device according to embodiment 2. The arrows in FIG. 6 indicate flows of cooling fluid that serves as heat medium during the preheat process. The arrows in FIG. 7 indicate flows of cooling fluid while the engine is running.

In this embodiment, a flow path Z for allowing, in the preheat process, the cooling fluid supplied into the interior of the cylinder block 12 from the thermal storage tank 20 to return to the thermal storage tank 20 again through the mechanical pump 40 and the three-way valve 50 is further provided in addition to the arrangement of the above-described embodiment 1.

With the above structure, as shown in FIG. 6, a circulative flow of cooling fluid running through the cylinder block 12 and the mechanical pump 40 also occurs in the preheat process in addition to the flow of cooling fluid that was described in connection with the above-described embodiment 1. By this flow, cold cooling fluid in the interior of the mechanical pump 40 is replaced by warm cooling fluid that has been stored in the thermal storage tank 20. Accordingly, as shown in FIG. 7, when the mechanical pump 40 operates after completion of the preheat process, the cooling fluid flowing into the cylinder block 12 from the mechanical pump 40 side through the inlet 12*b* is warm cooling fluid that has been stored in the thermal storage tank 20. Therefore, the cylinder block 12 is not cooled again, and it is possible to facilitate the warm-up process further.

The flows of cooling fluid while the engine is running are the same as those in the case of the above-described embodiment 1, as shown in FIG. 7.

<Others>

Comparisons of the internal combustion engines according to embodiments 1 and 2 and an internal combustion engine according to a related art will be described in the following with reference to FIGS. 8 and 9.

Figure 8:
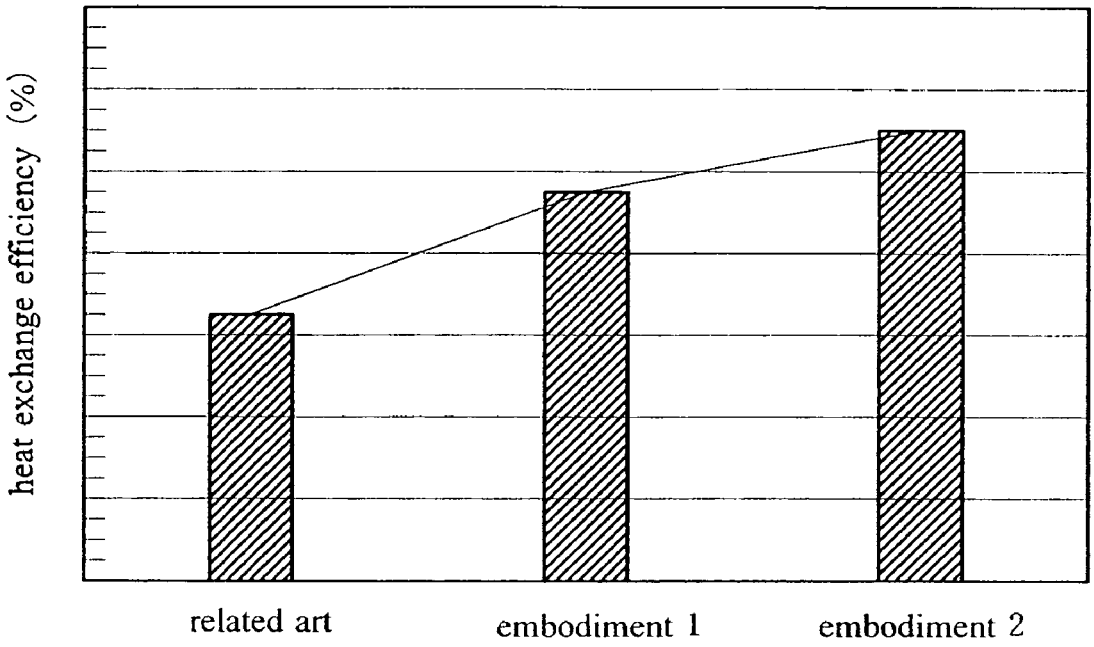
FIG. 8 shows graphs comparatively illustrating heat exchange efficiencies of an internal combustion engine according to a related art and the internal combustion engines according to embodiments 1 and 2.

FIG. 8 is a graph comparatively illustrating the heat exchange efficiencies of the internal combustion engine according to a related art and the internal combustion engines according to embodiment 1 and 2. The heat exchange efficiencies were computed based on measured values of the change in the temperature of the cooling fluid contained in the thermal storage tank before and after the preheat process. Specifically, the heat exchange efficiency is given by the following formula:

heat exchange efficiency (%)=(supplied heat quantity/100% supplied heat quantity)×100, where, supplied heat quantity=quantity of warm water supplied×specific heat×temperature change (i.e. temperature at the tank outlet minus temperature of fluid returning to the tank), and 100% supplied heat quantity=quantity of warm water supplied×specific heat×temperature change (i.e. temperature at the tank outlet minus temperature of the internal combustion engine before supplied with warm water). From the graph of FIG. 8, it will be seen that the internal combustion engines according to embodiments 1 and 2 have heat exchange efficiencies higher than that in the related art. In addition, among embodiments 1 and 2, embodiment 2 in which replacement of the cooling fluid in the interior of the mechanical pump 40 is effected during the preheat process has the higher heat exchange efficiency.

Figure 9A:
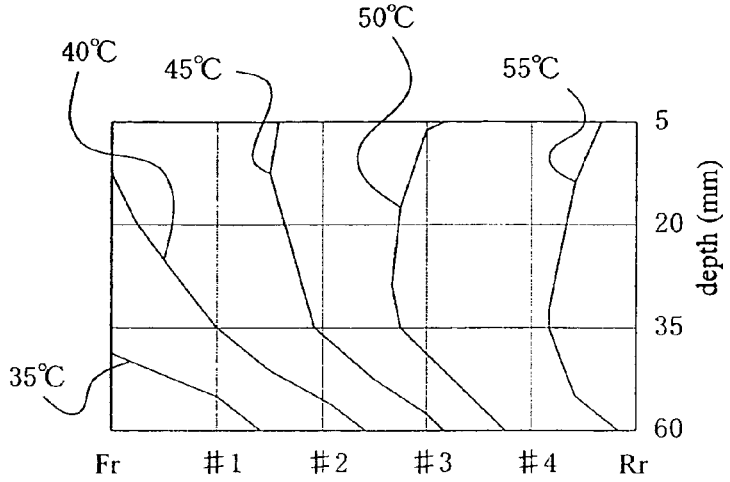
FIG. 9 shows temperature distributions on the wall surface of the cylinder block.
Figure 9B:
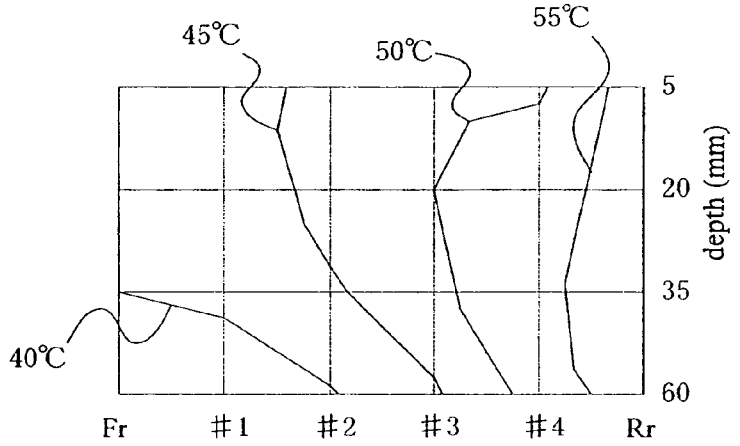
Figure 9C:
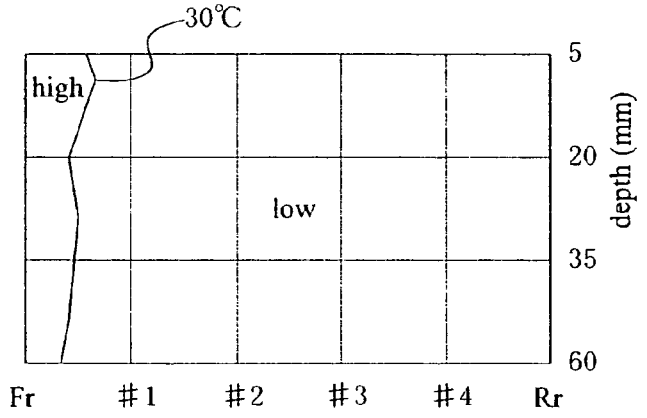

FIG. 9 shows temperature distributions on the wall surface of the cylinder block. The temperature distributions shown are temperature distributions on the wall surface of the cylinder block at a predetermined time after the start of the preheat process (or just after completion of the preheat process) for the internal combustion engine according to the related art and the internal combustion engines according to embodiments 1 and 2. In FIG. 9, FIG. 9A shows the distribution in embodiment 1, FIG. 9B shows the distribution in embodiment 2, and FIG. 9C shows the distribution in the related art. In each graph, the horizontal axis represents the position in the cylinder block along the anteroposterior direction as it is mounted on a vehicle, and the vertical axis corresponds to the depth direction of the cylinder block. Signs #1–#4 in the graphs indicate the positions of the center line of the respective cylinders. In these graphs, temperature curves are drawn for every five degrees (° C.).

From the temperature distributions, it will be seen that in the case of the internal combustion engine according to the related art, the temperature is high in the front side portion (or the left side portion in the graph) and decreases toward the rear side (or the right side in the graph). In addition, it will also be seen that the overall temperature of the cylinder block is low. This is because a large part of the warm cooling fluid supplied from the thermal storage tank flows to the cylinder head directly.

On the other hand, in the case of the internal combustion engines according to embodiments 1 and 2 of the present invention, it will be seen that the temperature of the cylinder block is relatively high in the rear side portion, and gradually decreases toward the front side. It will also be seen that the overall temperature of the cylinder block is significantly high as compared to the related art. This is because warm cooling fluid supplied from the thermal storage tank flows to the cylinder head after it flows all the regions of the cylinder block.

From the above comparison, it will be understood that the cylinder block can be warmed more efficiently in the embodiments of the present invention than in the related art.

As has been described in the foregoing, according to the present invention, it is possible to enhance the efficiency of warming the cylinder block by the thermal storage device. In addition, fuel consumption can be reduced accordingly.

What is claimed is:

1. An internal combustion engine having a thermal storage device comprising:

an engine main body having a cylinder block, a cylinder head and a cooling flow path through which heat medium flows to cool the engine;

a thermal storage tank for storing heat medium warmed by the engine while keeping its heat; and a heating flow path for feeding heat medium that has been stored in the thermal storage tank into the interior of the engine main body;

wherein a communication channel for allowing fluid communication between the cylinder block and the cylinder head is provided at one end side of the engine main body;

said cooling flow path includes a first flow path that allows heat medium to flow into the cylinder block from the one end side of the engine main body, to flow by way of the other end side of the engine main body, and then to flow into the cylinder head through the communication channel provided at the one end side of said engine main body, and a second flow path that allows heat medium to flow into the cylinder block from the one end side of the engine main body and to flow into the cylinder head directly through said communication channel; and said heating flow path is provided in such a way that heat medium supplied from said thermal storage tank to enter into the cylinder block from the other end side of the engine main body.

2. An internal combustion engine having a thermal storage device according to claim 1, wherein said heating flow path includes at least a part of said first flow path.

3. An internal combustion engine having a thermal storage device according to claim 2, wherein said one end side and said other end side are one and the other sides with respect to the direction of arrangement of a plurality of cylinders arranged in a row in the engine main body.

4. An internal combustion engine having a thermal storage device according to claim 3, wherein the engine further comprises a first pressure-feeding device for pressure-feeding heat medium in said heating flow path and a second pressure-feeding device for pressure-feeding heat medium in said cooling flow path, and the first pressure-feeding device feeds heat medium stored in said thermal storage tank into the engine main body in a state in which pressure-feeding operation by the second pressure-feeding device is being stopped.

5. An internal combustion engine having a thermal storage device according to claim 4, wherein said second pressure-feeding device comprises a mechanical pump whose drive source is the engine.

6. An internal combustion engine having a thermal storage device according to claim 5, wherein when pressure-feeding operation by the first pressure-feeding device is effected, a portion of the heat medium flows along a flow path running through said mechanical pump and returning to the thermal storage tank.

7. An internal combustion engine having a thermal storage device according to claim 2, wherein the engine further comprises a first pressure-feeding device for pressure-feeding heat medium in said heating flow path and a second pressure-feeding device for pressure-feeding heat medium in said cooling flow path, and the first pressure-feeding device feeds heat medium stored in said thermal storage tank into the engine main body in a state in which pressure-feeding operation by the second pressure-feeding device is being stopped.

8. An internal combustion engine having a thermal storage device according to claim 7, wherein said second pressure-feeding device comprises a mechanical pump whose drive source is the engine.

9. An internal combustion engine having a thermal storage device according to claim 8, wherein when pressure-feeding operation by the first pressure-feeding device is effected, a portion of the heat medium flows along a flow path running through said mechanical pump and returning to the thermal storage tank.

10. An internal combustion engine having a thermal storage device according to claim 1, wherein said one end side and said other end side are one and the other sides with respect to the direction of arrangement of a plurality of cylinders arranged in a row in the engine main body.

11. An internal combustion engine having a thermal storage device according to claim 10, wherein the engine further comprises a first pressure-feeding device for pressure-feeding heat medium in said heating flow path and a second pressure-feeding device for pressure-feeding heat medium in said cooling flow path, and the first pressure-feeding device feeds heat medium stored in said thermal storage tank into the engine main body in a state in which pressure-feeding operation by the second pressure-feeding device is being stopped.

12. An internal combustion engine having a thermal storage device according to claim 11, wherein said second pressure-feeding device comprises a mechanical pump whose drive source is the engine.

13. An internal combustion engine having a thermal storage device according to claim 12, wherein when pressure-feeding operation by the first pressure-feeding device is effected, a portion of the heat medium flows along a flow path running through said mechanical pump and returning to the thermal storage tank.

14. An internal combustion engine having a thermal storage device according to claim 1, wherein the engine further comprises a first pressure-feeding device for pressure-feeding heat medium in said heating flow path and a second pressure-feeding device for pressure-feeding heat medium in said cooling flow path, and the first pressure-feeding device feeds heat medium stored in said thermal storage tank into the engine main body in a state in which pressure-feeding operation by the second pressure-feeding device is being stopped.

15. An internal combustion engine having a thermal storage device according to claim 14, wherein said second pressure-feeding device comprises a mechanical pump whose drive source is the engine.

16. An internal combustion engine having a thermal storage device according to claim 15, wherein when pressure-feeding operation by the first pressure-feeding device is effected, a portion of the heat medium flows along a flow path running through said mechanical pump and returning to the thermal storage tank.

* * * * *